United States Patent [19]

Crisp, Sr.

[11] Patent Number: 4,979,817

[45] Date of Patent: Dec. 25, 1990

[54] HIGH STRENGTH SECURITY FENCE FOR SNARING VEHICLES

[75] Inventor: William T. Crisp, Sr., Oliver Springs, Tenn.

[73] Assignee: Barrier Concepts, Inc., Oak Ridge, Tenn.

[21] Appl. No.: 261,775

[22] Filed: Oct. 24, 1988

Related U.S. Application Data

[63] Continuation-in-part of Ser. No. 77,887, Jul. 27, 1987, abandoned.

[51] Int. Cl.[5] ..... E04H 17/20

[52] U.S. Cl. ..... 256/13.1; 256/19; 256/35; 256/68; 404/6

[58] Field of Search ..... 256/13.1, 19, 11, 22, 256/35, 36, 54, 55, 32, 68, 66; 404/6, 9

[56] References Cited

U.S. PATENT DOCUMENTS

| | | | |
|---|---|---|---|
| 1,848,246 | 3/1932 | Dowell | 256/13.1 |
| 2,337,626 | 12/1943 | Sawyer | 256/13.1 X |
| 2,635,857 | 4/1953 | Banister | 256/19 |
| 3,210,051 | 10/1965 | Case | 256/13.1 |
| 3,307,833 | 3/1967 | Müller et al. | 256/13.1 |
| 4,075,473 | 2/1978 | Winston | 256/13.1 |
| 4,475,843 | 10/1984 | Wyler | 256/55 X |

FOREIGN PATENT DOCUMENTS

| | | | |
|---|---|---|---|
| 1447684 | 9/1965 | France | 256/13.1 |

*Primary Examiner*—Peter M. Cuomo
*Attorney, Agent, or Firm*—Pitts and Brittian

[57] ABSTRACT

A high strength security fence for resisting penetration by vehicles. The fence has high strength line posts that support a plurality of tensioned high strength cables. In the preferred form, these cables are threaded through the posts. The cables are each encased in a conduit-type rail sheath (i.e., superstructure) that span the distance between the posts. Typically, at least one end of each cable is anchored within the concrete anchor of a post adjacent a line post supporting the cable. Cables can be anchored, and tensioned, at corner buttresses if desired. To improve the aesthetic appearance of the fence and to add further strength, the posts and rails can be encased in decorative superstructures, and vertical strengthening bars are joined to the rail superstructure. A clamp is described for joining the high strength fence to upright posts of conventional chain link fences or the like.

4 Claims, 3 Drawing Sheets

HIGH STRENGTH SECURITY FENCE FOR SNARING VEHICLES

This is a continuation-in-part application based upon parent application Ser. No. 77,887, filed July 27, 1987, now abandoned.

TECHNICAL FIELD

This invention relates generally to fences which are used to enclose an area to be protected, such as real property, and more particularly to high strength fences designed to preclude intrusion, and specifically high impact vehicular intrusion into a secured area. The fence includes unique methods and apparatus for withstanding strong impact of a potentially intruding vehicle.

BACKGROUND ART

Fences are commonly used to define the borders of real property and other areas to be protected and to discourage intrusion into the enclosed areas. A wide variety of fences are, of course, well known in the art and typically include fence posts variously anchored in the ground at preselected intervals and either a series of rails or cables affixed to and extending horizontally between the fence posts. Alternatively, various configurations of wire, mesh or other substances are variously attached to and extend between the fence posts.

A primary drawback of the prior art fences is their lack of strength. They are designed only to discourage rather than to prevent intrusion and cannot, for example, withstand the strong impact of high-speed vehicular intrusion attempts. Additionally, even known prior art high-strength boundaries have typically focused on the material of which they are constructed for their strength and have not provided a high-strength cable and impact-resistant anchor means for maintaining the fence in a substantially vertical position after impact. Moreover, known prior art boundaries have not combined strength with an aesthetically pleasing and deceptive but typical-looking exterior fence design even though such a deceptive appearance is highly desirable in many security applications, such as at diplomatic embassies, etc.

Since it is desirable to prevent vehicular intrusions, particularly at locations such as secure government and military installations, it is an object of the present invention to provide unique means and apparatus for preventing penetration of a fence by an intruding vehicle.

It is a further object of the present invention to provide unique means and apparatus for anchoring and tensioning the high strength fence cables.

Additionally, to further enhance the invention's ability to stop vehicular intrusion attempts, a further object of the invention is to provide unique means and apparatus for supporting and anchoring the fence.

Another object of the present invention is to maintain an aesthetically pleasing and deceptive appearance by encasing the rail and buttress superstructures to give the fence the appearance of a more typical fence design, such as a wrought iron fence or a rural, usually wooden, post and rail fence.

Yet another object is to provide a high-strength security fence which is constructed of non-deteriorating materials, which will require little maintenance and which can be relatively easily adjusted and repaired on site.

It is another object to provide apparatus for the attachment of the impact resistant fence to an already existing chain link fence.

A further object is to provide a high-strength fence which is in part prefabricated and thus can be manufactured using a relatively inexpensive process.

Other objects and advantages will become apparent upon a consideration of the following drawings and a complete description thereof.

DISCLOSURE OF THE INVENTION

The fence of the present invention comprises a snare means for snaring or immobilizing an intruding vehicle upon impact. The snare means includes a plurality of high strength cables, each of which have two end portions. The cables are encased in a conduit or the like and are supported and held at selected positions above the surface of the area to be protected with a post means. The post means includes one or more posts, each of which includes a post superstructure with a first end fixed in the surface of the area to be protected, a further end extending vertically from the surface. At least one end of the cables can be anchored by corner buttress means. Also, one or more ends of the cables can be anchored in the anchor means of a post means adjacent a post means supporting the cable. The cables are further strengthened by a tensioning means which adjustably controls the tension of the cables. Additionally, in a preferred embodiment, the fence further comprises a rail superstructure means for covering the encased cables between the posts, and vertical strengthening rods joined to the rail superstructure means.

BRIEF DESCRIPTION OF THE DRAWINGS

FIG. 5 is a drawing illustrating a typical clamp for connecting the fence of FIGS. 1 and/or 2 to a conventional chain link fence or the like.

BEST MODE FOR CARRYING OUT THE INVENTION

Figure 1:
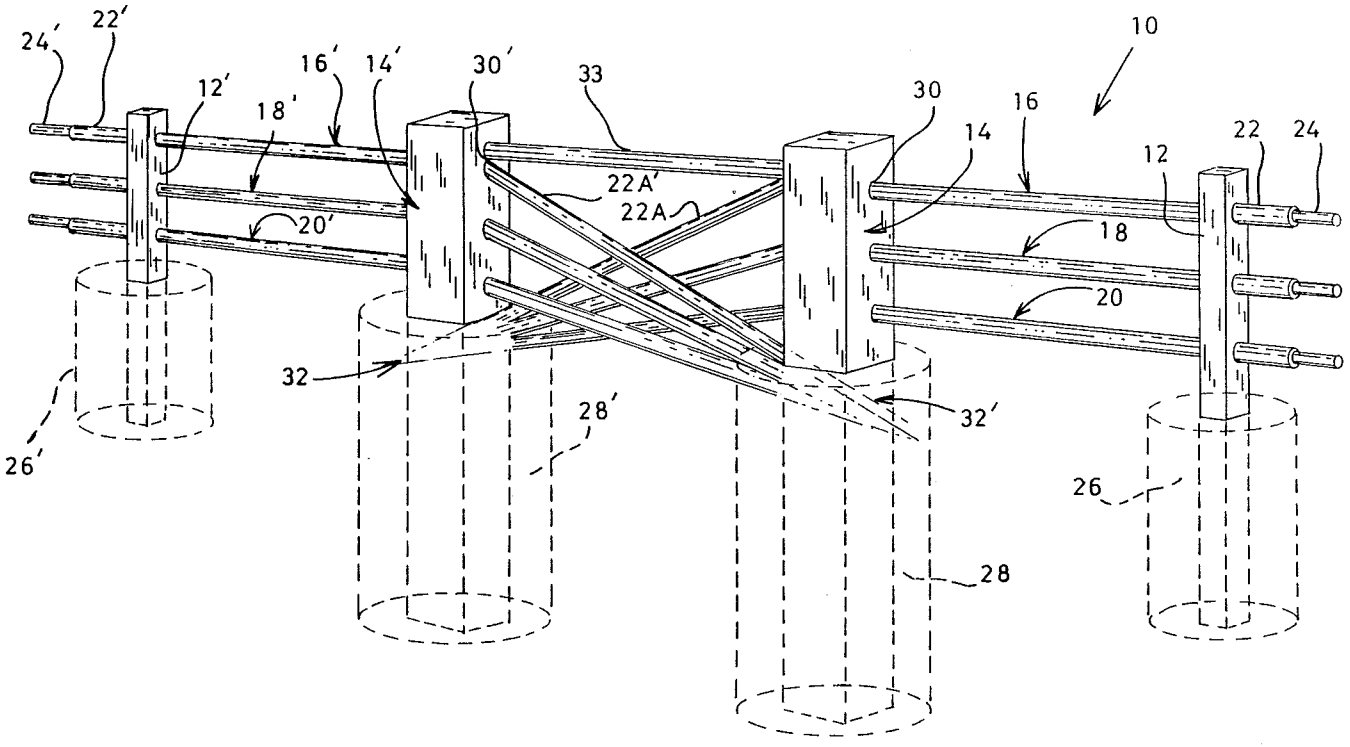
FIG. 1 is a perspective view of a segment of one embodiment of the present invention illustrating typical posts, rails and a means for terminating the cables that thread the fence rails.

Referring now to FIG. 1, shown generally at 10 therein is one embodiment of a fence constructed in accordance with the various features of the present invention. This particular embodiment is a utilitarian type fence for use in withstanding the strong impact of high speed vehicular intrusion attempts. Although indicated as being formed in a straight line, this fence could also take on any contour to enclose a specific area to be protected. In this embodiment, there are a plurality of line posts, such as indicated at 12 and 12', that can be square in cross section as illustrated or can have other suitable cross-sections. Typically, each of these line posts extends approximately four feet above ground level. In order to have sufficient strength to resist penetration of the fence, these line posts 12, 12' are formed of steel, or like materials, and can be filled with concrete and reinforcing rods (not shown). These line posts are typically separately separated at spacings of about 10 feet, although other spacings certainly are within the scope of the invention. For purposes to be described in detail hereinafter, posts 14, 14' having a larger cross section can be interposed at various positions along the length of the fence. These, too, typically are metal and are filled with concrete or like materials. Furthermore, they can include reinforcing rods if desired or necessary. Typically, the metal of the posts is ¼ inch thick.

The posts are used to support a plurality of rails, such as indicated at 16, 18 and 20, as well as the corresponding rails 16', 18' and 20'. Each of these rails in this embodiment are formed from a sheath 22 through which is threaded a high strength cable 24. This sheath can be typically fabricated of galvanized metal, plastic, vinyl, etc. Typically, the cables are 1 inch in diameter and have about 105,000 pound tensible strength. This construction for rail 16' also includes an outer sheath 22' threaded by a high strength cable 24'. The remaining cables are fabricated in a similar fashion. Each of the line posts is securely anchored in vertical orientation using, for example, approximately three feet of concrete, or like material. In order to anchor the larger posts 14, 14', typically, the concrete anchor is 6 feet in depth. These concrete anchors are indicated at 26, 26', 28 and 28', respectively.

The function of the larger posts 14, 14', referred to as "super posts", is to provide a high strength termination for cables 24, 24' and their enclosures 22, 22'. It will be recognized that large high strength cables typically are manufactured in standard lengths, such as one hundred feet. Since it is difficult to effectively join lengths of such cables, which typically are one inch in diameter, the construction of anchoring means in FIG. 1 consists of passing the sheath 22 and its cable 24 through super post 14 at a point identified at 30. After passing through this post 14, the sheath 22 is bent downwardly as indicated at 22A at an angle such that the end thereof and its cable terminate at 32 within the concrete anchor 28' used to anchor super post 14'. It is this construction that is referred to hereinafter as "securing an end of the cable in the concrete anchor of a post means adjacent a post means supporting the cable". The details of the passage of these elements through super post 14 and the anchoring will be described in more detail in connection with FIGS. 3 and 4. It can be seen that the other rails 18 and 20 are likewise passed through the super post 14, bent downwardly and anchored in the concrete anchor 28' as indicated. In a like manner, rail 16' made up of the enclosure 22' and its cable 24' pass through super post 14' at 30' and are bent downwardly as indicated at 22A' so as to enter and be anchored at 32' in concrete anchor 28 for super post 14. The other rails 18' and 20' are similarly anchored as at 32'. A tie bar 33 spans the gap between super posts 14, 14' to complete the fence at this point.

Figure 3:
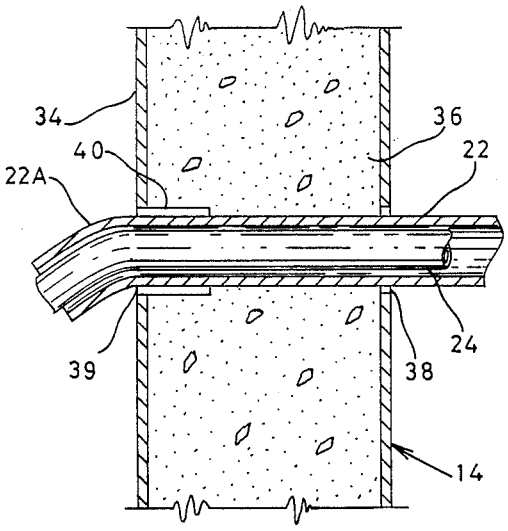
FIG. 3 is a cross-sectional drawing of a portion of one of the posts illustrated in FIG. 1 illustrating the passage of cable and rail means through a post means.
Figure 4:
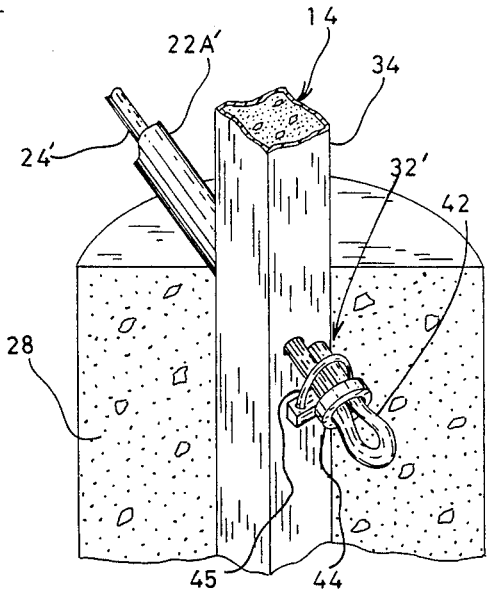
FIG. 4 is a cross-sectional drawing illustrating a typical anchoring of a cable end in a post anchor means.

More details of this anchoring system can be understood by referring now to FIG. 3 and FIG. 4. In FIG. 3 it can be seen that the super post 14 is formed from a shell 34 (typically square in cross section) filled with a substance such as concrete as indicated at 36. The enclosure or sheath 22 having a cable 24 therethrough, passes through the shell 34 as at opening 38 and exits at the opposite side through an opening 39. If desired to strengthen the super post at this point, a sleeve 40 can be used surrounding the opening 39. After leaving the super post, the sheath is bent downwardly as previously indicated and indicated at 22A in this figure.

In FIG. 4 it is indicated how the actual end of the rail (or cable) is anchored into a concrete footing or anchor such as indicated at 28. This shows the sheath 22A', having its cable 24' threaded therethrough, passing through post 14. As indicated at the opposite surface of the post 14, the cable 24' is bent back upon itself, as indicated at 42, with the ends secured as with a hardened ring 44 and a clamp 45. Alternately, the clamp can be fastened to the end of the cable 24' without forming the loop 42. The cable end can be enlarged by other suitable means, also, so as to be securely anchored in the concrete. In this way, the cable can be tensioned and adequately anchored such that each portion of the fence 10 will adequately resist penetration by a high speed vehicle.

Figure 2:
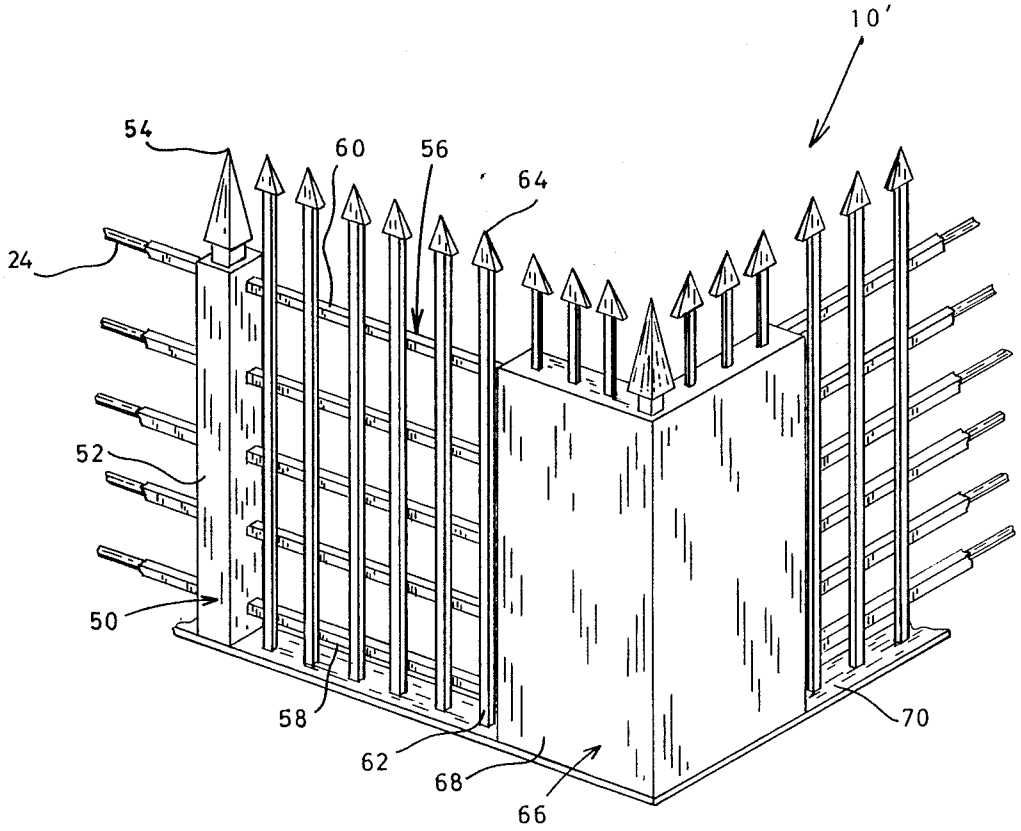
FIG. 2 is a pictorial view of one embodiment of the exterior of a high strength security fence having improved aesthetic quality constructed according to the present invention.

Referring now to FIG. 2, shown at 10' therein is another embodiment of the present invention. This particular embodiment is made to be aesthetically pleasing and typically looking of fences used in many security applications such as at diplomatic embassies, etc. so as to be deceptive of its strength. This fence similarly has a plurality of line posts such as indicated at 50. These can be constructed internally similar to the post shown in FIG. 1 and then encased in a decorative superstructure 52. This superstructure 52 typically terminates in a pointed top 54 to achieve this aesthetic appearance. This particular embodiment employs five substantially parallel rail means as indicated at 56, 58 etc., although more or less rails can be utilized in accordance with the present invention. In order to make the fence 10' conform to the intended style, each of the rails, such as rail 56 is similar to the rails shown in FIG. 1, except that each has a decorative superstructure such as indicated at 60. Thus, each rail has a aesthetically pleasant appearance but retains the high strength impact resistance characteristics desired for the security fence. To further add to the strength of the fence and its appearance, a plurality of vertical bars 62 are attached to the exterior surface of the superstructures 60 with each terminating in a typical top point 64.

Indicated in this FIG. 2 is the treatment of the security fence of the present invention at corners of the fence. A typical corner includes a buttress means 66 enclosed in a superstructure 68. This superstructure is typically anchored to the ground in a manner similar to the individual posts 50. Further, the buttress means typically includes tensioning means for the cables of the rails. This tensioning means can be any suitable adjustment means to provide the adequate tension of the cables 24 to reduce the possibility of penetration of the fence by a high speed vehicle. Persons skilled in the art of fences will understand the necessity for this tensioning and will understand any suitable means for accomplishing the same. Although not shown in this figure, cable terminating and clamping means, such as indicated in FIG. 1 at ends of cables can be included in the fence where the length of any particular run is to exceed the normal length of the cables. This decorative embodiment of the present invention can also include a fence base strip as indicated at 70. This base strip provides for the easy maintenance of the ground proximate the fence such as lawn mowing and trimming. Further, this base strip adds to the aesthetic qualities of this embodiment of the fence. In this embodiment, the superstructure of the posts and rails are typically joined as with welding. Similar construction is used where the rail superstructure joins the buttress superstructure. In a similar fashion, the vertical reinforcing bars 62 are joined to the rail superstructures as by welding. Thus, it is seen that the embodiment of FIG. 2 conforms in appearance to fences typically utilized around certain installations.

Figure 5:
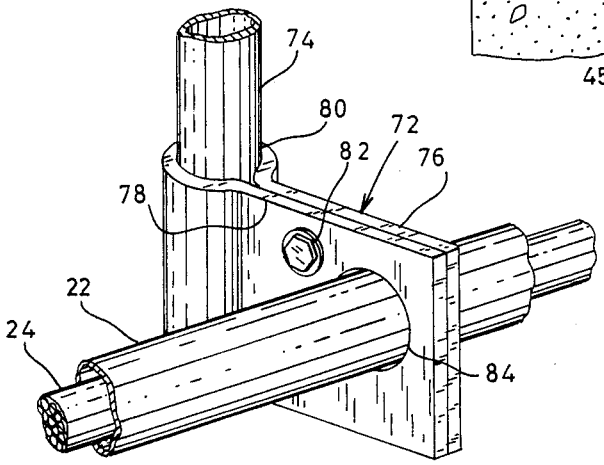

There may be applications of the fence of FIG. 1 wherein it is desirable to join this security fence to a conventional chain link fence or the like. In order to accomplish this type of installation, a clamp such as indicated at 72 in FIG. 5 is provided. This clamp 72 is designed to be fastened to a conventional post 74 of the chain link fence. The clamp consists of two confronting legs 76 and 78 that encircle the post 74 as at 80. These legs are joined together with, for example, one or more bolt units 82. The clamp is provided with an aperture 84 whereby the sheath 22 of the cable 24 passes therethrough such that the security fence of the present invention can be securely attached to the aforementioned post 74 of a conventional fence. In this manner, the conventional fence posts 74 provides additional rigidity to the posts of the security fence 10 thereby further preventing possible penetration by a vehicle or other object. With this construction, the line posts of the high strength security fence can be spaced farther apart, e.g., at fifty foot spacing.

From the foregoing it will be understood by those versed in the art that a high security fence construction has been provided to prevent penetration by a high speed vehicle or like object. Primary strength is afforded by the construction of the posts and the rails that are supported thereby. Furthermore, superstructures can be added to these elements to create a fence with an aesthetic and deceptive appearance such that its strength characteristics are not immediately evident. Suitable terminating means for the cables used in each of the rails has been described, in addition, such that a practical high strength security fence is provided for any type of application.

Although the present invention has been described with respect to specific embodiments, it is not intended that such specific embodiments be considered as limitations upon the scope of the invention. The invention is to be limited solely by the appended claims and their equivalents when read in combination with the detailed description of the apparatus.

I claim:

1. An improved high-impact, vehicle-stopping security fence for enclosing an area and surface to be protected, said fence capable of withstanding impact by, and imparting disabling damage to, a vehicle potentially intruding into said area, at least a portion of said improved fence being arranged in segments, and which comprises:

a plurality of high strength line post means positioned along at least a portion of the perimeter of said area and surface to be protected, said line post means including a line post superstructure having a top end extending upwardly from said surface, and a bottom end extending to at least proximate said surface;

anchor mean at each of said line post means for securing said bottom ends of said line post superstructure to said surface;

a plurality of extra high strength superpost means interposed periodically along the length of said fence, said superpost means including a superpost superstructure having a top end extending upwardly from said surface, and a bottom end extending to at least proximate said surface;

superpost anchor means at each of said superpost means for securing said bottom ends of said superpost superstructure to said surface;

a plurality of tensioned high strength cables, supported by said line and superpost means, said cables penetrating said superstructure of said line and superpost means and being substantially parallel to each other and to said surface for that portion of their length extending between said supporting line and superposts, said cables each having opposite end portions which together define the limits of a segment of said fence and which extend downwardly from the superstructures of first and second said superposts, being opposite end superposts of a first said segment to, and being securely anchored to and immersed within, said superpost anchor means of second and third said superposts proximate said first and second said superposts, respectively, said second and third said superposts being the end superposts of segments of said fence adjacent to said first and second ends of said first fence segment;

a plurality of rail superstructures, each enclosing one of said cables, substantially parallel to said surface for that portion of their length extending between said line and super-post means, said rail superstructures being hollow so as to coaxially receive said one cable, each of said rail superstructures having opposite end portions extending downwardly from a first said superpost superstructure to, and being securely anchored within, said superpost anchor means of a second said superpost proximate said first superpost;

securing means at said opposite end portions of said cables to establish and maintain tensioning of said cables, whereby said line and superpost means, said cables, and said rail superstructures are enabled to withstand said impact; and clamp means for attachment of one said rail superstructures to a vertical post of an adjacent fence, said clamp means having a U-shaped body member formed by confronting legs, said body member for embracing said post of said adjacent fence, said legs joined in confronting relationship by fastener means, said legs provided with aligned apertures to receive said rail superstructure.

2. A vehicle snaring and improved security fence for enclosing an area and surface to be protected, said fence capable of withstanding strong impact by, and resultantly thereof, imparting damage to, a vehicle potentially intruding into said area, said area having a perimeter, at least a portion of said fence being arranged in segments, and comprising:

a plurality of line post means positioned along said perimeter at substantially uniform spacing, said line post means including a line post superstructure having a top end extending upwardly from said surface and a bottom end extending beneath said surface;

a concrete anchor means beneath said surface at each of said line post means, said concrete anchor means at least closely surrounding said bottom end of said line post superstructure;

a plurality of extra high strength superpost means interposed periodically along the length of said fence, said superpost means including a superpost superstructure having a top end extending upwardly from said surface, and a bottom end extending to at least proximate said surface;

concrete superpost anchor means at each of said superpost means for securing said bottom ends of said superpost superstructure to said surface;

a plurality of tensioned high strength cables, supported by said line and superpost means, said cables penetrating said superstructure of said line and superpost means and being substantially parallel to each other and to said surface for that portion of their length extending between said supporting line and superposts, said cables each having opposite end portions which together define the limits of a segment of said fence and which extend downwardly from the superstructures of first and second said superposts, being opposite end superposts of a first said segment, to, and being securely anchored to and immersed within, said concrete superpost anchor means of second and third said superposts proximate said first and second said superposts respectively, said second and third said superposts being the end superposts of second and third segments of said fence adjacent to said first and second ends, respectively, of said first fence segment;

securing means at said opposite end portions of each of said cables to establish and maintain tension of said cables, said securing means on at least one of said opposite end portions of each of said cables being an enlargement of said cable, said enlargement being immersed in said concrete superpost anchor means of a superpost means adjacent a line post means supporting said cable;

a plurality of rail superstructures, each enclosing one of said cables, substantially parallel to said surface for that portion of their length interposed between said line and super-post means, each of said rail superstructures being hollow so as to receive said one cable, each of said rail superstructures having opposite end portions extending downwardly from a first said superpost superstructure to, and being securely anchored within, said concrete superpost anchor means of a second said superpost proximate said first superpost;

a plurality of rail strengthening bars attached to said rail superstructures intermediate said line and superpost mean, said bars substantially equally spaced apart and oriented substantially vertically to said surface; and clamp means for attachment of one said rail superstructures to a vertical post of an adjacent fence, said clamp means having a U-shaped body member formed by confronting legs, said body member for embracing said post of said adjacent fence, said legs joined in confronting relationship by fastener means, said legs provided with aligned apertures to receive said rail superstructure.

3. The fence of claim 2 wherein said securing means at one opposite end portion of each of said cables is a buttress means in said fence, said buttress means provided with means for tensioning each of said cables.

4. A vehicle snaring and improved security fence for enclosing an area and surface to be protected, said fence capable of withstanding strong impact by, and rendering immobile resultantly of said impact, a vehicle potentially intruding into said area, said area having a perimeter, said fence comprising:

a plurality of line post means positioned along at least a portion of said perimeter at substantially uniform spacing, said line post means including a line post superstructure having a top end extending upwardly from said surface and a bottom end extending beneath said surface;

a concrete anchor means beneath said surface at each of said line post means, said concrete anchor means at least closely surrounding said bottom end of said line post superstructure;

a plurality of extra high strength superpost means interposed periodically along the length of said fence between certain of said line post means, said superpost means including a superpost superstructure having a top end extending upwardly from said surface, and a bottom end extending to at least proximate said surface;

concrete superpost anchor means at each of said superpost means for securing said bottom ends of said superpost superstructure to said surface;

a plurality of tensioned high strength cables, supported by said line and superpost means, said cables penetrating said superstructure of said line and superpost superstructures and being substantially parallel to each other and to said surface for that portion of their length extending between said supporting line and superposts, each of said cable each having a first and second end;

first securing means at said first ends of said cables to establish tension of said cables, said securing means at said first ends being buttress means provided with tensioning means;

second securing means at said second ends of said cables to secure said cables against intrusion by said vehicle, said second securing means being an enlargement of said cables immersed in said concrete anchor means of a superpost means adjacent a line post means supporting said cable;

a plurality of rail superstructures, each enclosing one of said cables, substantially parallel to said surface for that portion of their length interposed between said line and super-post means, each of said rail superstructures being hollow so as to receive said one cable, each of said rail superstructures having first and second ends, said first ends being immersed in said buttress means together with said first securing means, and said second ends extending downwardly to and being securely immersed within said superpost anchor means together with said second securing means;

a plurality of rail strengthening bars attached to said rail superstructures intermediate said line and superpost mean, said bars substantially equally spaced apart and oriented substantially vertically to said surface; and clamp means for attachment of one said rail superstructures to a vertical post of an adjacent fence, said clamp means having a U-shaped body member formed by confronting legs, said body member for embracing said post of said adjacent fence, said legs joined in confronting relationship by fastener means, said legs provided with aligned apertures to receive said rail superstructure.

* * * * *